United States Patent [19]

Vitale

[11] Patent Number: 4,817,319

[45] Date of Patent: Apr. 4, 1989

[54] COLLAPSIBLE SIGN

[76] Inventor: Ralph S. Vitale, 14943 Masonic, Warren, Mich. 48093

[21] Appl. No.: 63,235

[22] Filed: Jun. 17, 1987

[51] Int. Cl.[4] ..... G09F 15/00; G09F 17/00

[52] U.S. Cl. ..... 40/610; 40/603

[58] Field of Search ..... 40/603, 606, 607, 610

[56] References Cited

U.S. PATENT DOCUMENTS

| | | | |
|---|---|---|---|
| 1,406,916 | 2/1922 | Arnold | 40/606 |
| 2,515,818 | 7/1950 | Bennett | 40/606 |
| 3,135,235 | 6/1964 | Romano | 116/63 |
| 3,219,300 | 11/1965 | Gunderson | 40/610 X |
| 3,305,960 | 2/1967 | Huey et al. | 40/125 |
| 3,470,641 | 10/1969 | Meyer | 40/145 |
| 3,526,200 | 9/1970 | Doyle | 40/125 |
| 3,527,434 | 9/1970 | Mauro | 248/166 |
| 3,557,479 | 1/1971 | Allison et al. | 40/125 |
| 3,591,116 | 7/1971 | Dalum | 40/125 |
| 3,677,511 | 7/1972 | Dicke | 248/448 |
| 3,726,031 | 4/1973 | Singer | 40/31 |
| 3,740,880 | 6/1973 | Sweet et al. | 40/610 |
| 3,744,167 | 7/1973 | Slavsky | 40/125 H |
| 3,775,887 | 12/1973 | Precourt | 40/125 G |
| 3,792,678 | 2/1974 | Rowland | 116/63 P |
| 3,815,860 | 6/1974 | Bompart | 248/464 |
| 3,847,335 | 11/1974 | Ross | 248/166 |
| 4,038,769 | 8/1977 | Werner | 40/125 H |
| 4,059,915 | 11/1977 | Owens | 40/125 H |
| 4,087,785 | 5/1978 | Dodich | 340/114 B |
| 4,103,445 | 8/1978 | Smith et al. | 40/125 G |
| 4,178,874 | 12/1979 | Berns et al. | 116/28 R |
| 4,232,466 | 11/1980 | Mathis | 40/606 |
| 4,233,769 | 11/1980 | Archer | 40/610 |
| 4,241,530 | 12/1920 | Hartwig | 40/610 X |
| 4,426,801 | 1/1984 | Gates | 40/606 |
| 4,512,098 | 4/1985 | Ready et al. | 40/610 |
| 4,609,133 | 9/1986 | Anderson | 224/317 |
| 4,619,220 | 10/1986 | Seely et al. | 116/63 P |

*Primary Examiner*—Ira S. Lazarus
*Assistant Examiner*—Peggy Neils
*Attorney, Agent, or Firm*—Gifford, Groh, Sheridan, Sprinkle and Dolgorukov

[57] ABSTRACT

A collapsible sign includes a web supported by a collapsible frame. The collapsible frame includes two vertical legs and a cross member releasably secured to the tops of the legs. Casings are formed along three edges of the rectangular web and enclose the framing members. The cross member is secured to the top of the legs using a resilient tubular connector adapted to slide over and tightly engage the ends of the legs and cross member. A method for erecting a collapsible sign is also disclosed. When disassembled, the sign may be collapsed or rolled into a compact cylindrical package.

7 Claims, 2 Drawing Sheets

COLLAPSIBLE SIGN

BACKGROUND OF THE INVENTION

I. Field of the Invention

This invention relates to collapsible sign and, in particular, to a temporary collapsible sign having a web stretched across a collapsible framing member.

II. Description of the Prior Art

Numerous collapsible signs have been devised, typically for use in warning motorists of a construction zone or of a stranded vehicle in an emergency. Collapsible signs are previously known which include a foldable base or frame for supporting a rigid sign member. For example, U.S. Pat. Nos. 3,557,479, 3,677,511, 4,038,769, and 4,609,133 each disclose a collapsible sign of this general type. In the first three mentioned patents, a base or stand is pivotably secured to an upright support member. The support member is adapted to hold an unfolded, rigid sign. The stand or base is pivoted so that the legs are displaced away from the central upright member to provide lateral stability for the sign.

U.S. Pat. No. 4,609,133 discloses a vehicle emergency sign including a frame for inserting a sign and a support adapted to display the sign above a vehicle by attachment to its roof and the upper edge of a closed window. Although each of the above mentioned signs are capable of being collapsed to a substantially flat, two dimensional object, they are still somewhat bulky and awkward for transporting or storing.

An improved collapsible sign is disclosed in U.S. Pat. No. 4,103,445. This patent discloses a frame consisting of two legs and a cross piece, and an elastic web stretched between the legs, and held thereto by large retaining clips. The cross piece is substantially larger than the legs and is hollow to enable the insertion of bent portions at the ends of the legs into the hollow cavity. The other ends of the legs can then be forced apart to elastically stretch the intervening web. This collapsible sign can be disassembled and the cross piece arranged parallel to the legs, and the web member can be rolled around the legs and cross piece to form a substantially cylindrical package for storing or transporting. However, because of the size and bulkiness of the hollow cross piece and the web retaining clips on the legs, this design still occupies more space than is desirable.

SUMMARY OF THE PRESENT INVENTION

These and other disadvantages are overcome by the present invention. The collapsible sign of the present invention includes a collapsible frame constructed of two upright frame members and a cross frame member. However, the frame members, including the cross frame member, have substantially the same width. Preferably they are made of solid steel rod stock. Each end of the cross member is releasably secured to one end of a respective leg by means of a resilient connector. Preferably, one end of a tubular connector slides over the end of the cross member while the other end of each tubular connector slides over the upper end of the respective legs. The opposite ends of the legs are preferably tapered or sharpened for being easily driven into the ground.

A flexible web, preferably made of a durable fabric, extends between the legs and the cross member of the collapsible frame. The web is generally rectangular in shape and three of the four sides have overlapping flaps forming casings therein. The casings on opposing sides of the web are adapted to slidably receive the upright leg members while the casing on the upper adjacent side is adapted to slidably receive the cross member. The web includes indicia on one or both sides.

In a different embodiment of the collapsible sign a second cross member is inserted through a casing on the fourth or lower side of the web and is releasably secured to the upright members. In this manner, the web is supported and stretched between the two cross members and between the two upright members and two pairs of resilient connectors hold the frame members together.

The collapsible sign of the present invention is easily erected by inserting the upright leg members through the opposing casings of the web and driving them into the ground while drawing the web taut. The cross member is then slid through the casing at the upper edge of the web and is inserted into the tubular connectors at the top of each upright leg member. The cross member strengthens the collapsible frame and tightens and supports the sign web.

BRIEF DESCRIPTION OF THE DRAWING

The present invention will be more fully understood by reference to the following detailed description when read in conjunction with the accompanying drawing in which like reference characters refer to like parts throughout the several views and in which.

DETAILED DESCRIPTION OF THE PREFERRED EMBODIMENT

Figure 1:
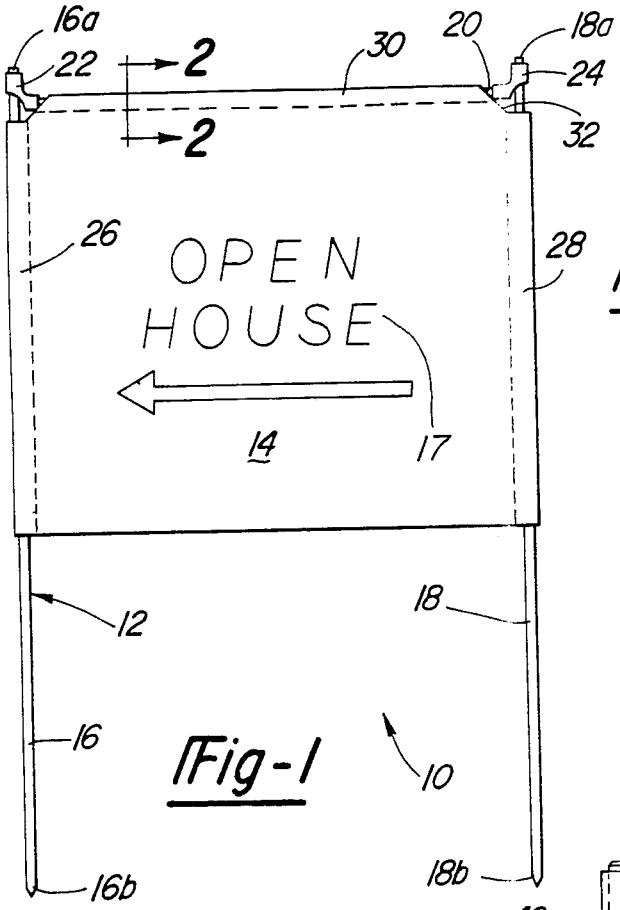
FIG. 1 is a front plan view of the preferred embodiment according to the invention.

Referring first to FIG. 1, the collapsible sign is there shown comprising a collapsible frame 12 and a flexible web 14 stretched across the frame 12. The collapsible frame 12 comprises two upright leg members 16 and 18 and a cross member 20. The cross member 20 extends from the upper end **16*a* of one leg 16 to the upper end 18*a* of the other leg 18. Resilient connectors 22 and 24, which will subsequently be described in detail connect the cross member 20 to the leg 16 and the leg 18, respectively. The lower ends 16*b* and 18*b* of the legs 16 and 18 preferably are tapered or pointed so that the frame 12** can be driven into the ground easily.

The frame members 16, 18 and 20 may be constructed of any rigid material and may have any cross sectional shape. However, for compact collapsibility each frame member has substantially the same width in the range of about ⅛ to ½ inch. Smaller or larger dimensions are possible depending on the size of the sign 10. In the preferred embodiment the frame members 16, 18 and 20 are cylindrical and are constructed of ¼ inch steel rod stock. It is of course contemplated that other metals, particularly lightweight metals and alloys such as Aluminum and Magnesium, and other non-metals such as wood or fiberglass may also be used for the frame members 16, 18 and 20.

The web 14 is rectangular in shape and has indicia 16 preferably displayed on both the front and back faces of the web 14. Casings 26 and 28 are formed in opposing sides of the web 14 and are adapted to receive the legs 16 and 18, respectively. Similarly, a casing 30 is formed long an upper edge of the web 14 and is adapted for receiving the cross member 20. Thus, as shown in FIG. 1, the sign web 14 is supported on the cross member 20 and is stretched tautly at its upper edge by the cross member 20 and at its lower edge by spreading the legs 16, 18 prior to driving them into the ground (not shown). Preferably, the rectangular shape of the web 14 is modified by the removal of material to form notches 32 in the upper corners. The notches 32 facilitate operation of the resilient connectors 22, 24.

The web 14 may be constructed of any flexible material that can be rolled up. For signs that must endure inclement weather, canvas or plastic are preferred materials. The web 14 must be flexible yet durable, and must be capable of imprinting with indicia 16. Typically, the sign web 14 is about 1½ feet in height and about 2 feet in width although any size may be employed.

Figure 2:
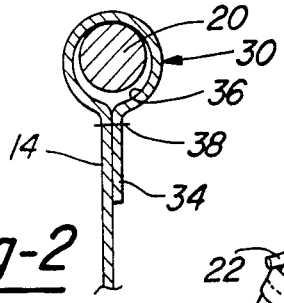
FIG. 2 is a cross section taken along line 2—2 of FIG. 1.

Referring now to FIG. 2, the casing 30 along the upper edge of web 14 is shown in enlarged cross section. An extension or flap 34 of the web 14 is folded back upon itself to form a tubular pocket or cavity 36. The pocket 36 is adapted to slidably receive the cross member 20 to support the web 14. The flap 34 is fastened to the web 14 by any convenient means such as stitches, glue, rivets or fusion. It should be noted that the casings 26 and 28 in opposing sides of the web 14 are essentially identical to the casing 30 and therefore will not be described in any additional detail.

Figure 4:
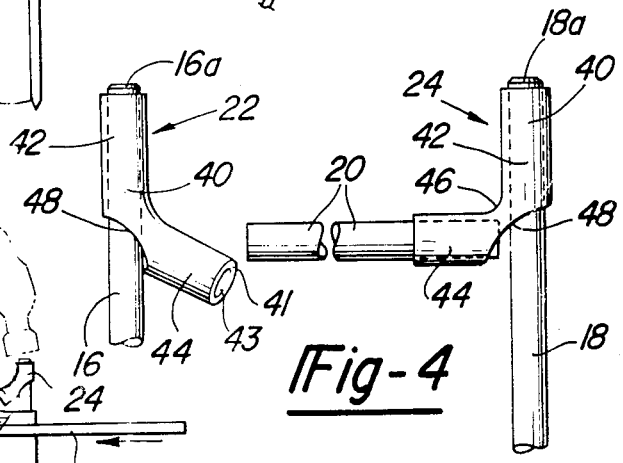
FIG. 4 is an enlarged plan view of the tubular connectors.

Referring now to FIG. 4, the resilient connectors 22, 24 are essentially identical and hereinafter will be described. The resilient connector 22 comprises a section of flexible tubing 40 which can be made of plastic or rubber. In the preferred embodiment, the tubing 40 is made of extruded plastic and comprises a tubular wall 41 defining a lumen 43. The tubing 40 is divided into a vertical portion 42 and a horizontal portion 44 by a bend 46 and a corresponding notch 48. The bend 46 and the notch 48 are located approximately at the midpoint of the tubular wall 41 so that the length of horizontal portion 44 is about equal to the length of the vertical portion 42. The notch 48 extends through the tubular wall 41 approximately one third to one half the distance of the outer diameter of the tubing 40. The notch 48 may be V shaped or curvilinear as desired and it should extend into the lumen 43 of the tubing 40.

The tubing 40 is selected so that the dimension of its lumen 43 corresponds with the width dimension or diameter of the frame members 16, 18 and 20. In particular, as shown in FIG. 4, the lumen 43 of the horizontal portion 44 is dimensioned to tightly engage the ends of the cross member 20. In a similar fashion, the lumen 43 of the vertical portion 42 is dimensioned to tightly engage the upper ends **16*a*, 18*a* of the legs 16, 18. Prior to assembly, the tubing 40 assumes a relaxed state, as shown on the left in FIG. 4, in which the vertical portion 42 and the horizontal portion 44 form an obtuse angle. When assembled however, as shown on the right in FIG. 4, the vertical portion 42 and the horizontal portion 44** form substantially a right angle.

Figure 3:
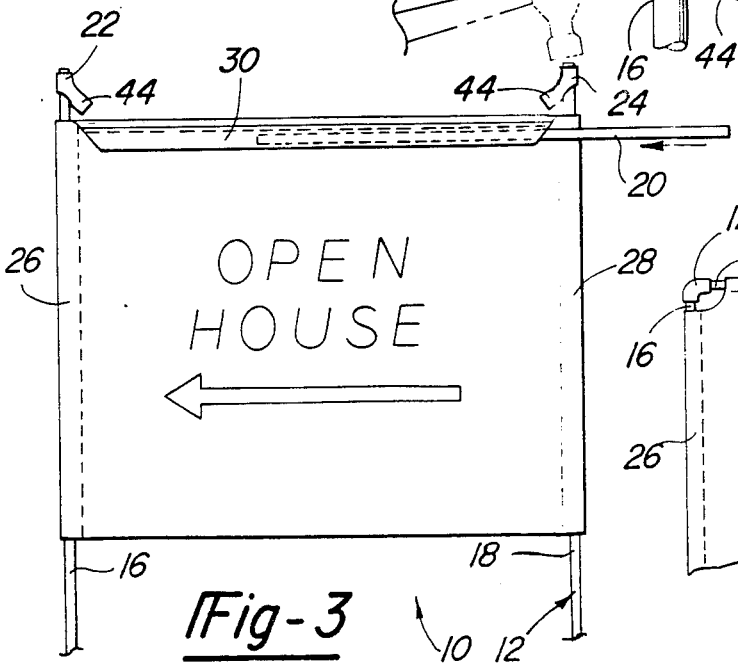
FIG. 3 is a plan view similar to FIG. 1, but showing the sign in the process of installation.

Referring now to FIG. 3, a sign 10 according to the present invention is easily erected. First, the legs 16 and 18 are inserted through the casings 26 and 28 respectively of the web 14. The legs 16 and 18 are inserted so that the upper end **16*a*, 18*a* which contain the resilient connectors 22, 24 are uppermost while the lower ends 16*b* and 18*b* extend downwardly. These lower edges 16*b* and 18*b* are driven into the ground (now shown) by any convenient means such as the hammer 52. It is important to draw the web 14 taut before driving the second of the legs 16 or 18. Furthermore, it is important to drive each of the legs 16 and 18 so that they are essentially parallel to one another and so that their tops 16*a* and 18*a* define a horizontal line. Once the legs 16, 18 are in place, the cross member 20 is slid into the casing 30 and is connected to the horizontal portion 44 of each of the resilient connectors 22, 24. The connectors 22, 24 typically remain attached to the tops 16*a*, 18*a* of the legs 16, 18 and may be permanently attached thereto. The cross member 20 serves to support the web 14 and to provide structural rigidity to the collapsible frame 12**.

Figure 5:
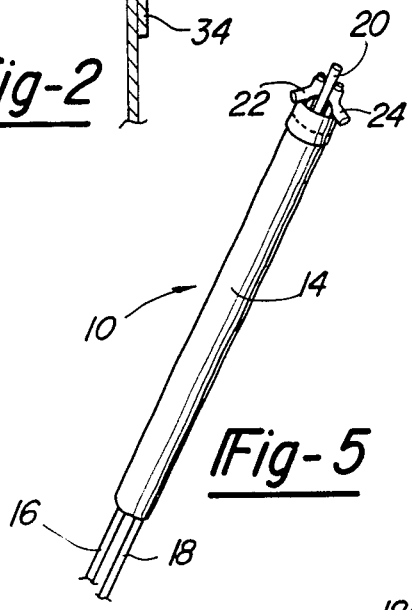
FIG. 5 is a perspective view of the sign in its rolled or collapsed state.

Referring now to FIGS. 3 and 5, the collapsible sign 10 of the present invention is easily disassembled and stored in a compact cylindrical package. First, the cross member 20 is removed from the resilient connectors 22, 24 and from the casing 30. Then, upon removal of the legs 16, 18 from the ground, the web 14 can be rolled from one casing 26 to the other casing 28, rolling the cross member 20 into the center. As best shown in FIG. 5, the result is a compact cylindrical package which can easily be stored and/or transported in a tubular container such as a mailing tube. For example, a collapsible sign 10 made according to the present invention can easily be stored in a cardboard tube having a diameter of two inches.

Although the preferred embodiment shows the top end **16*a*, 18*a* of the legs entering the lumen 43 of the tubing 40 at the notch 48 and protruding slightly above the vertical portion 42, it is to be understood that modification of this s also within the invention. For example, the tubing 40 of the resilient connectors 22, 24 may be secured to the top ends 16*a*, 18*a* in an upside down manner. Specifically, the resilient connectors 22, 24 could be arranged such that the notches 48 and the horizontal portions 44 are disposed above the vertical portions 42. Although not shown, this arrangement could eliminate the protrusion of the legs 16 and 18 above the upper edge of the sign web 14**.

The first described embodiment is advantageous and preferred, however, because downward force on the cross member 20, such as that exerted by the effect of gravity on the web 14, stresses the tubing 40 at the interior of the bend 46 and tends to draw the legs 16 and 18 closer to the ends of the cross member 20. In contrast, in the second described arrangement, downward force on cross member 20 strains the tubing 40 in the area of the notch 48 and tends to separate the cross member 20 from the legs 16 and 18. This tendency is, of course, limited by the tension of the web 14 drawing the legs 16, 18 together.

Figure 6:
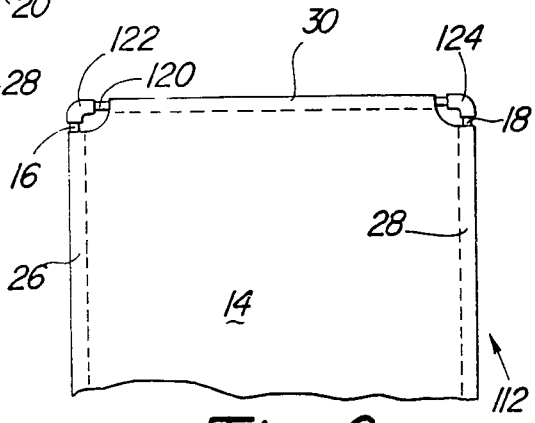
FIG. 6 is a front plan view of a second preferred embodiment according to the invention.

Referring to FIG. 6, a version of the invention includes resilient connectors 122 and 124 which comprise a section of tubing having no notch 48. In this embodiment, the resilient connectors 122 and 124 each comprise sections of plastic or rubber tubing having a lumen open to both ends. A slightly shorter cross piece 120 is inserted into the lumen at one end of each of the connectors 122, 124. The lumen at the other end of the connectors 122, 124 is slid over the upper ends of the legs 16 and 18 respectively. The frame 112 formed by the connectors of this embodiment has radiused corners as shown in FIG. 6.

Figure 7:
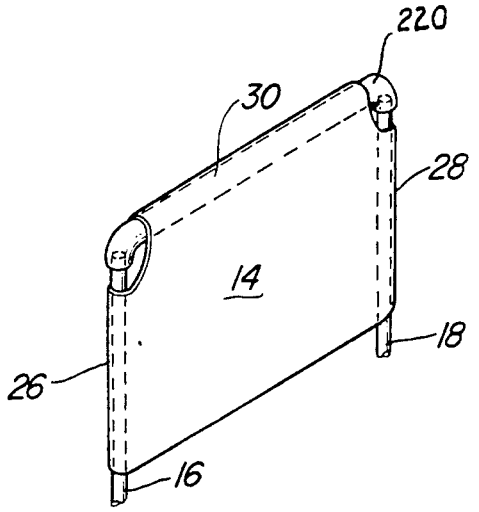
FIG. 7 is a plan view of a modified embodiment of the cross member.

Referring now to FIG. 7, another version of the invention comprises the usual web 14 and the usual upright members 16 and 18. The web 14 includes casings 26, 28 and 30 as previously described. However, a cross member 220 made of extruded plastic tubing extends from the top of one upright member 16 to the top of the other upright member 18 through the upper casing 30. The cross member 220 incorporates both the cross frame member and the resilient connectors of the previous embodiment.

Figure 8:
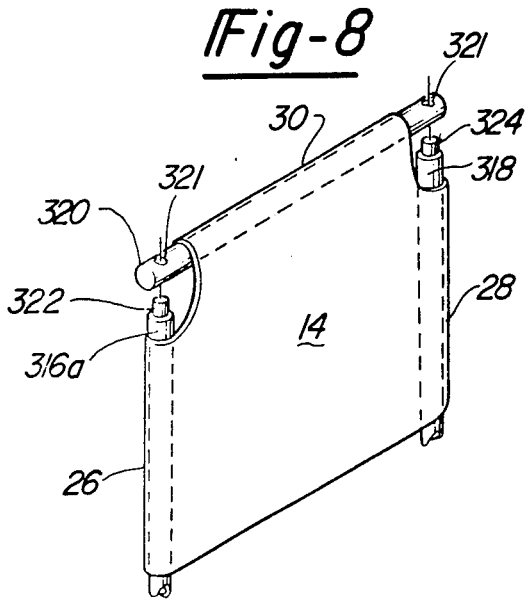
FIG. 8 is a plan view of a modified embodiment of the securing means.

Referring now to FIG. 8, another version of the means for releasably securing is there shown. The web 14, including casings 26, 28 and 30 are similar to those previously described. The top end 316*a*, 318*a* of the upright members each include a reduced diameter portion or pin 322, 324, respectively. The pins 322, 324 extend coaxially a short distance above the top of the upright members. A modified cross member 320 includes orifices 321 at each end of the cross member 320. The orifices 321 are dimensioned to slide over and engage the pins 322, 324 of the upright members. Thus, the cross member 320 supports the web 14 while it maintains the spaced relationship between the top ends 316*a* and 318*a* of the upright members. The cross member 320 of this version may be cylindrical, as in the previously described preferred embodiments, or it may be a substantially flat bar.

Figure 9:
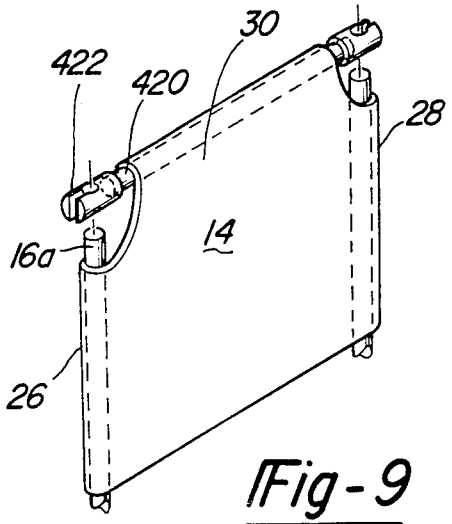
FIG. 9 is yet another modified embodiment of the securing means.

Referring now to FIG. 9, a modified resilient connector 422 is there shown in detail. Upright member 16*a* and web 14 are similar to those previously described, including the casings 26, 28 and 30. A cross member 420 carries on each end a resilient connector 422 which preferably comprises a U-shaped snap clip. The clip is dimensioned and adapted to securely engage the top end of a respective upright members 16*a* or 18*a*.

In each of the above-described embodiments, the length of the cross member 20, 120, 220, 320 and 420 may vary slightly from one embodiment to the next. The length of the cross frame member is important because, when secured to the upright members, the web should be stretched tautly from one side to the other. Accordingly, in the embodiment shown in FIG. 8, it is the spacing between the orifices 321 which is critical rather than the actual length of the cross member 320. Some flexibilty in length of the cross members is tolerable depending on the type of resilient connector employed.

Figure 10:
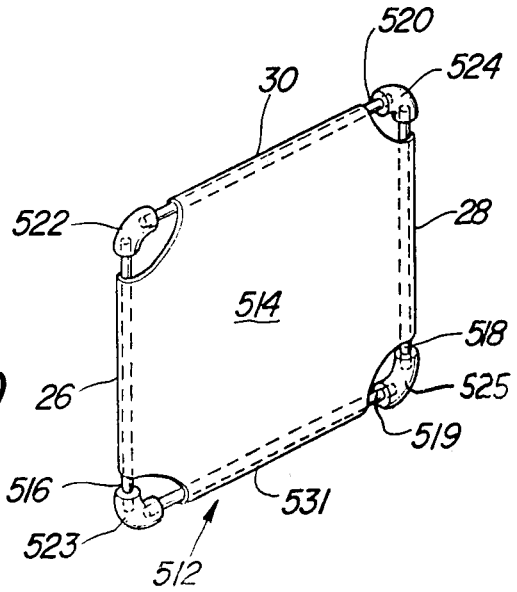
FIG. 10 is a second embodiment of a collapsible sign according to the present invention.

Referring now to FIG. 10, a second preferred embodiment of a collapsible sign according to the present invention is there shown. This embodiment of the sign is adaptable for hanging on a wall or otherwise supporting. A frame 512 comprises two upright members 516 and 518 and two cross members 519 and 520. The upper ends of the upright members 516 and 518 are connected to the first cross member 520 by means of resilient connectors 522 and 524. The connectors 522 and 524 may be any type of resilient connector including any of those previously described. The lower ends of the upright members 516 and 518 are connected by a second cross members 519, using resilient connectors 523 and 525. Once again, the resilient connectors 523 and 525 may be any resilient connector, including those previously described. A modified web 514 has casings 26 and 28 formed in its side edges and a casing 30 formed in its upper edge. These casings are similar to those previously described. However, a fourth casing 531 is formed in a lower edge of the web 514 opposite the casing 30. The lower casing 531 is adapted to slidably receive the second cross members 519. The web 514 and/or the frame members 516, 518, 519 and 520 are dimensioned so that, when assembled, the web 514 is stretched tautly across the members of the frame 512.

Although not shown in the drawing, it is within the contemplation of the present invention that the resilient connectors 523 and 525 are connected to an intermediate point of the upright members 516 and 518, rather than at their lower ends. The resilient connectors 22, 24 shown in detail in FIG. 4, would be ideally suited for such an application. In this manner, the sign of FIG. 10 may include downwardly extending legs, as does the sign of FIGS. 1–9, as well as two cross members extending between the upright members in place of only one.

It can be seen from the foregoing discussion that the collapsible sign 10 of the present invention provides a quick and easy means of displaying signing at a particular location. Although other uses are certainly within the scope of the invention, the collapsible sign 10 seems particularly adapted for temporary signing such as the indication of an open house. Because the framing members z are each made of small diameter rod stock, the entire sign can be rolled into a very compact cylindrical package for storing or transporting, as is frequently required in the real estate business. The small size of the framing members makes the collapsible sign 10 of the present invention advantageous over previously known collapsible signs.

The foregoing detailed description of the various preferred embodiments has been given for clearness of understanding only and no unnecessary limitations should be understood therefrom. Some modifications will be obvious to those skilled in the art to which the invention pertains, without deviation from the spirit of the invention as defined by the scope of the appended claims.

I claim:

1. A collapsible sign comprising:

a collapsible frame including two upright frame members and at least one cross frame member, each of said frame members having two ends, said frame further including means for releasably securing each end of said at least one cross member to a first upper end of a respective one of said upright members, wherein each of said frame members has substantially the same width;

a flexible web;

means for releasably attaching said web to said frame members so that the web extends tautly between each of said upright members and is supported by said cross member; and wherein said means for releasably securing comprises two resilient and flexible connectors, each connector adapted to engage an end of said at least one cross member and the first end of a respective one of said upright members;

wherein said resilient connectors comprise flexible tubular members having a tubular wall defining a central lumen, said central lumen being adapted to fit over and tightly engage the ends of said cross member and said upright member;

wherein each of said tubular members includes a notch centrally disposed through said tubular wall to facilitate bending of said tubular member.

2. The sign as defined in claim 1 wherein said tubular members comprise segments of extruded plastic.

3. The sign as defined in claim 1 wherein said at least one cross member is releasably secured to said upright member at substantially a right angle.

4. The sign as defined in claim 1 wherein said web comprises fabric.

5. The sign as defined in claim 1 wherein said means for attaching comprises hollow casings formed in said web by folding a flap of said web over onto itself and fastening it thereto, said casings being adapted to receive said frame members therethrough.

6. The sign as defined in claim 1 wherein each of said upright frame members and said at least one cross frame member comprises a solid cylindrical rod.

7. The sign as defined in claim 6 wherein said rods comprise metal.

* * * * *